US010054292B2

(12) United States Patent
Munarin et al.

(10) Patent No.: US 10,054,292 B2
(45) Date of Patent: Aug. 21, 2018

(54) LIGHTING DEVICE AND METHOD OF MANUFACTURING IT

(71) Applicant: OSRAM GmbH, Munich (DE)

(72) Inventors: Marco Munarin, Paese (IT); Martin Reiss, Sinzing (DE); Alberto Alfier, Vedelago (IT); Thomas Rieger, Aufhausen (DE)

(73) Assignee: OSRAM GMBH, Munich (DE)

( * ) Notice: Subject to any disclaimer, the term of this patent is extended or adjusted under 35 U.S.C. 154(b) by 122 days.

(21) Appl. No.: 15/182,684

(22) Filed: Jun. 15, 2016

(65) Prior Publication Data

US 2016/0363293 A1 Dec. 15, 2016

(30) Foreign Application Priority Data

Jun. 15, 2015 (IT) ..... 102015000023731

(51) Int. Cl.

| | |
|---|---|
| ***F21V 15/00*** | (2015.01) |
| ***F21V 15/01*** | (2006.01) |
| ***F21V 31/00*** | (2006.01) |
| ***F21V 31/04*** | (2006.01) |
| ***F21V 19/00*** | (2006.01) |
| ***F21S 4/22*** | (2016.01) |
| *F21Y 103/10* | (2016.01) |

(Continued)

(52) U.S. Cl.

CPC ..... *F21V 15/012* (2013.01); *F21S 4/22* (2016.01); *F21V 15/013* (2013.01); *F21V 19/004* (2013.01); *F21V 31/005* (2013.01); *F21V 31/04* (2013.01); *F21Y 2101/00* (2013.01); *F21Y 2103/10* (2016.08); *F21Y 2115/10* (2016.08)

(58) Field of Classification Search

None

See application file for complete search history.

(56) References Cited

U.S. PATENT DOCUMENTS 5,607,227 A * 3/1997 Yasumoto ..... H04N 1/00909 257/100

8,366,291 B2 * 2/2013 Hoffmann ..... F21S 8/022 362/222

(Continued)

FOREIGN PATENT DOCUMENTS

| | | |
|---|---|---|
| EP | 1691131 A2 | 8/2006 |
| EP | 2287525 A1 | 2/2011 |
| EP | 2824380 A1 | 1/2015 |

OTHER PUBLICATIONS

Italian Search Report based on IT 102015000023731 (8 pages) dated Mar. 22, 2016 (for reference purpose only).

*Primary Examiner* — Christle I Marshall

(74) *Attorney, Agent, or Firm* — Viering Jentschura & Partner MBB

(57) ABSTRACT

In various embodiments, a lighting device is provided. The lighting device includes a channel-shaped elongate profiled body having a central or web portion and two side portions sidewise of the web portion, a profiled body having mutually opposed undercuts opening inwardly of the channel shape of profiled body, and a light radiation source assembly including an elongate support board carrying one or more light radiation sources, e.g. LED sources, the support board having longitudinal sides extending into the said undercuts, wherein the light radiation source assembly is retained by the channel-shaped profiled body.

12 Claims, 3 Drawing Sheets

(51) Int. Cl.
*F21Y 115/10* (2016.01)
*F21Y 101/00* (2016.01)

(56) References Cited

U.S. PATENT DOCUMENTS

| | | | | |
|---|---|---|---|---|
| 2010/0328947 | A1 | 12/2010 | Chang et al. | |
| 2013/0201654 | A1* | 8/2013 | Pickard | H01L 33/58 362/84 |
| 2014/0104838 | A1* | 4/2014 | Reiss | F21K 9/00 362/249.06 |

* cited by examiner

LIGHTING DEVICE AND METHOD OF MANUFACTURING IT

CROSS-REFERENCE TO RELATED APPLICATION

This application claims priority to Italian Patent Application Serial No. 102015000023731, which was filed Jun. 15, 2015, and is incorporated herein by reference in its entirety.

TECHNICAL FIELD

Various embodiments relate generally to lighting devices.

One or more embodiments may refer to lighting devices employing electrically-powered light radiation sources, such as solid state sources, e.g. LED sources.

BACKGROUND

Lighting devices implemented as flexible linear modules are available on the market.

Such devices are available also in a "protected" version, wherein a flexible light engine is embedded into a flexible shield (case) which may be made e.g. of polymer material.

The case protects the light engine from the outer environment, with a minor impact on light output performance.

The related manufacturing processes may involve the lamination on an extruded polymeric profile of an unprotected flexible module (e.g. a board such as a flexible Printed Circuit Board, PCB) carrying various components, such as said light radiation sources, DC/DC drivers, resistors, etc., which may optionally be mounted via SMD technology.

This operation may involve dispensing one or more viscous polymers (e.g. adapted to act as a glue/sealant once cured), optionally in the context of a reel-to-reel process, the laminated products moving on carousels, e.g. with fixed curing ovens, while the components (profiled case and light engine) are moving with respect to the ovens.

In the manufacturing processes envisaging a temperature curing, the need is felt to take into account the different thermal elongations of the flexible lighting module and of the extruded polymeric profile. At least in some cases, an instability may arise in the lamination of the flexible module onto the profile, causing the appearance of waving or twisting along the module.

One way to reduce waving involves the use of a tape sandwiched between the extruded profile and the flexible lighting module, while the assembly comprising the lighting module and the extruded profile undergoes the application of a "potting" material, e.g. a liquid transparent polymer which is subsequently cured, the tape being adapted to absorb the different thermal elongations while curing.

Another possibility involves reducing the module length. If the module length is lower than the length of the curing oven, the flexible module and the extruded profile have no bond at either end, and may therefore slide locally one with respect to the other, in such a way as to absorb the different thermal elongations. A variant consists in achieving the curing of the module via a series of exposures, i.e. in subsequent steps wherein for example a 6 meter long module is processed in 15 subsequent steps, each covering a length of $6/15=0.4$ meters.

SUMMARY

Various embodiments provide a lighting device.

Various embodiments also concern a corresponding method.

One or more embodiments lead to the achievement of one or more of the following advantages:

it is possible to prevent the flexible lighting device and the extruded profile from developing waving (i.e. from "warping") during the lamination process, e.g. when the latter involves a temperature curing;

irrespective of the manufacturing process being used, it is possible to obtain an accurate positioning of the lighting module with respect to the extruded profiled body.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
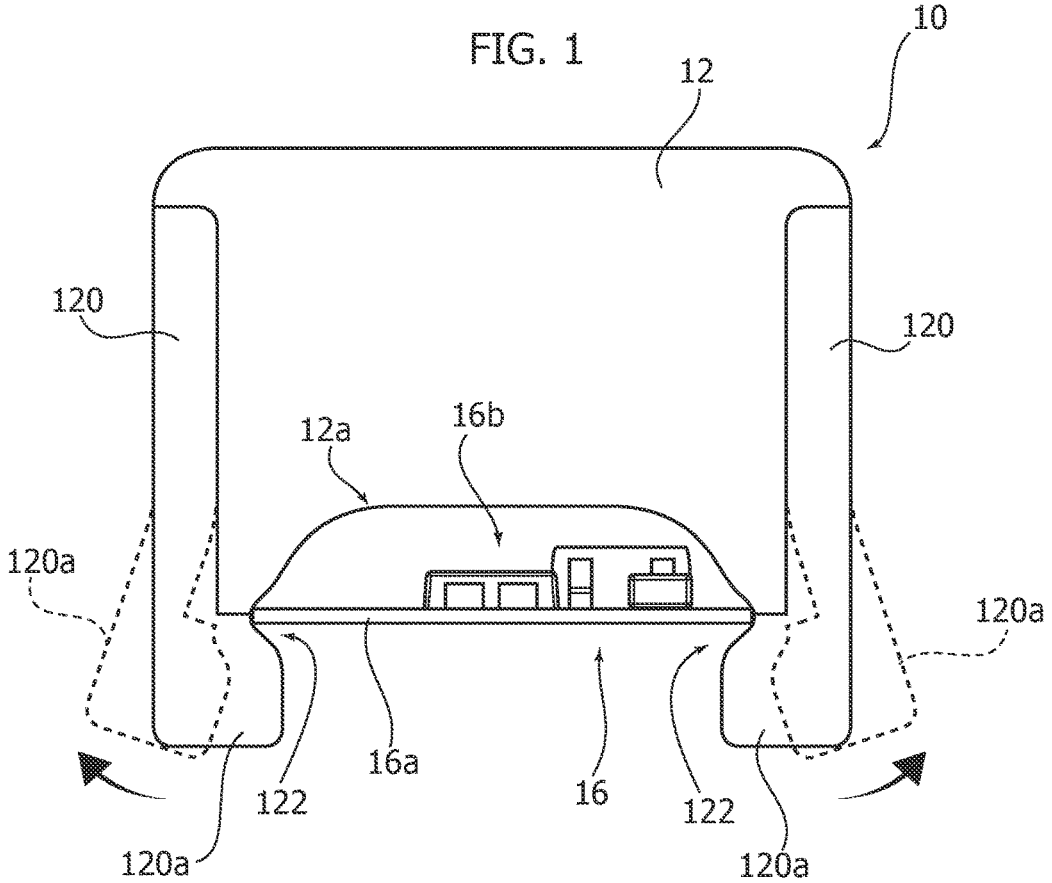
FIG. 1 shows in cross section a lighting device according to one or more embodiments.

In the following description, numerous specific details are given to provide a thorough understanding of one or more exemplary embodiments. The embodiments may be practiced without one or several specific details, or with other methods, components, materials, etc. In other instances, well-known structures, materials, or operations are not shown or described in detail to avoid obscuring various aspects of the embodiments.

Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, particular features, structures, or characteristics may be combined in any suitable manner in one or more embodiments.

The headings provided herein are for convenience only, and therefore do not interpret the extent of protection or meaning of the embodiments.

In the Figures, reference 10 denotes a lighting device adapted to be implemented, in one or more embodiments, as an elongated module (e.g. a bar or a tape), optionally flexible and/or adapted to be cut to length according to the application and use requirements.

Device 10 may therefore be considered as an element of indefinite length, shown in the views of FIGS. 1 to 4 in cross section with respect to the direction of the main extension thereof.

In one or more embodiments, device 10 may comprise an elongated profiled body with a channel-shaped cross-section profile, and therefore adapted to comprise a web portion 12 located between two side portions 120, which may consist, according to a choice which is not mandatory, in two inserts extending lengthwise of web portion 12 along the sides of the channel-like shape.

In one or more embodiments, web portion (or central portion) 12 and side portions (e.g. inserts) 120 may be formed by a single co-extrusion process.

In one or more embodiments, central part 12 may comprise a light-permeable, i.e. transparent, material, and lateral inserts 120 may consist of a light-impermeable material, e.g. an opaque and optionally white material.

In one or more embodiments, both central portion 12 and lateral inserts 120 may be made of a polymeric material (e.g. silicone), the opaqueness of inserts 120 being due to the presence of a filler material, e.g. alumina ($AL_2O_3$).

Such a filler material may optionally be added also to central portion 12, which is light-permeable (in a lower percentage than the amount of filler which is adapted to make inserts 120 opaque) so as to impart light diffusivity features to central portion 12.

In one or more embodiments, central portion 12 may include a mouth portion 12*a*, located internally between side portions 120 projecting with respect to central portion 12, said mouth portion 12*a* having an overall concave shape, the concavity facing outwardly of the channel-like shape of profiled body 12, 120.

In one or more embodiments, body 12, 120 may house, e.g. at mouth portion 12*a* and/or with the possible sandwiching of a light-permeable polymeric layer 14 therebetween (see FIG. 4), a light engine 16.

In one or more embodiments, light engine 16 may comprise:

a support board 16*a* substantially corresponding to a Printed Circuit Board (PCB), optionally flexible in the same way as profiled body 12, 120, and one or more electrically-powered light radiation sources 16*b*, e.g. LED sources.

In one or more embodiments, light radiation source(s) 16*b* may be located at the face of support board 16*a* facing central portion 12 of the profiled body.

In this case, in operation, the light radiation emitted by source(s) 16*b* may therefore be directed towards said central portion. If it comprises a light-permeable and optionally light-diffusing material (in the same way as sealing layer or mass 14, if present), central portion 12 of the body may cause the light radiation to be emitted by device 10 at the face of the profiled body opposed to mouth portion 12*a*. Moreover lateral inserts 120, thanks to the opaqueness (light-impermeability) and to the optional white colour that they exhibit, may cooperate in directing the light radiation emitted by light engine 16 towards said output face.

In one or more embodiments, both the profiled body (including lateral portions/inserts 120) and light engine 16 may be flexible, e.g. in an up-down direction with reference to the viewpoint of FIGS. 1 to 4.

In one or more embodiments, as exemplified in FIGS. 1 to 4, the channel-shaped profile of profiled body 12, 120 may comprise, e.g. at the lateral edges of mouth portion 12*a*, two undercuts (i.e. two grooves) 122, which may house the longitudinal sides of board 16*a* of light engine 16. As a consequence, board 16*a* (and light engine 16) are retained inside profiled body 12, 120. Moreover, the longitudinal sides of board 16*a* may still slide lengthwise with respect to both undercuts 122 wherein such sides are retained.

FIGS. 1 to 4 exemplify various implementations of undercuts 122.

For example, in FIG. 1 undercuts 122 consist in two grooves having a V-shaped cross-section profile, one side or wall of the V-shaped profile being defined by one of the longitudinal sides of mouth portion 12*a*, and the other side or wall of the V-shaped profile being defined by an expanded head portion 120*a* of respective lateral insert 120.

Figure 2:
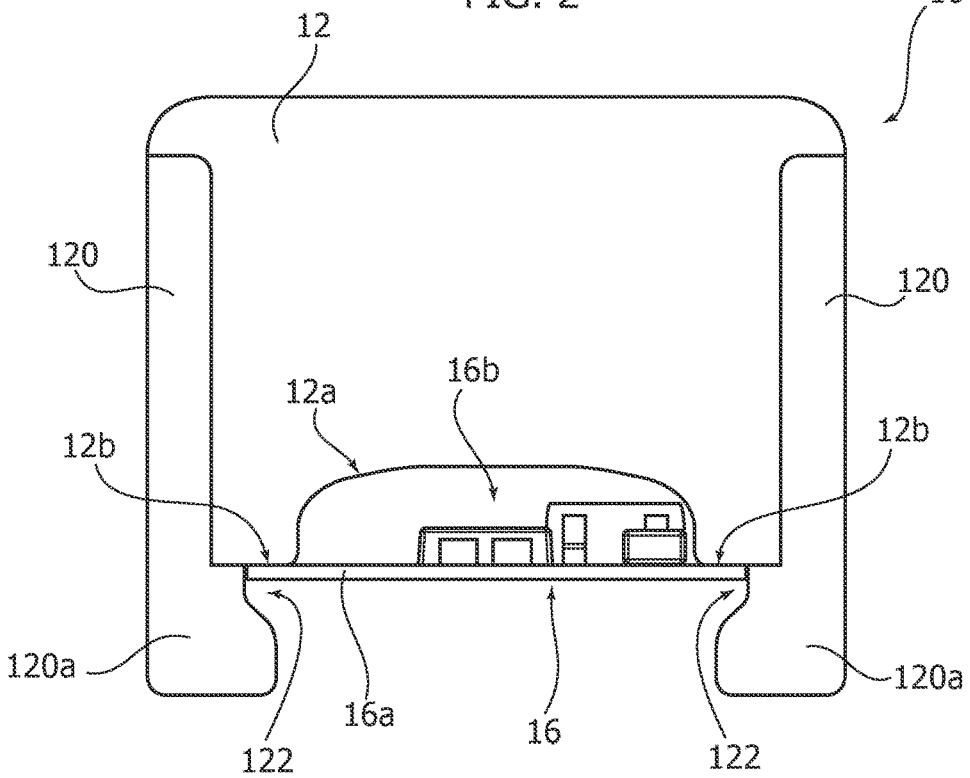
FIGS. 2 to 4 show possible modifications according to one or more embodiments.

A substantially similar solution is shown in FIG. 2; unlike the first example, in the present case mouth portion 12*a* has a narrower cross-section profile, and on both sides thereof there are provided abutment surfaces 12*b* contacted by the sides of board 16*a*, the latter being retained in the abutment position by the expanded head portion 120*a* of lateral inserts 120.

Figure 3:
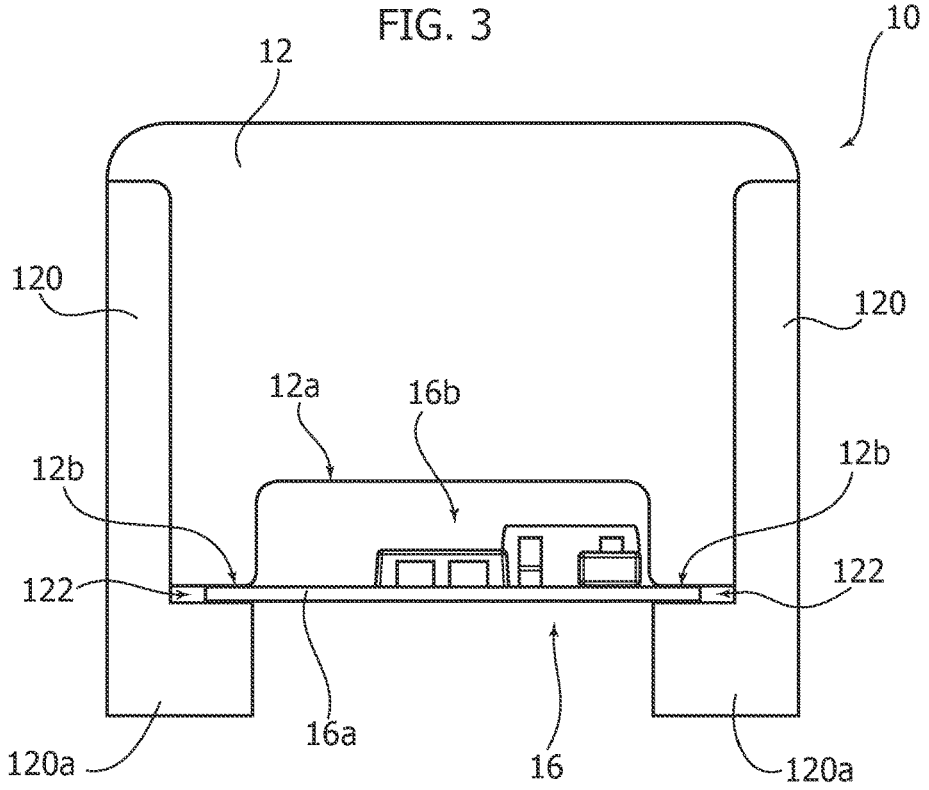

FIG. 3 shows a solution which is substantially similar to FIG. 2, the difference consisting in board 16*a* having a width that is at least slightly smaller than the width of the seat defined by undercuts 122, which face one another; each side of board 16*a* may therefore cooperate, with a play, with the bottom of corresponding undercut 122. This may further facilitate the relative sliding of the sides of board 16*a* with respect to undercut surfaces 122 of profiled body 12, 120.

Whatever the specific implementation details, in one or more embodiments undercuts 122 may be located between web portion 12 of the profiled body and lateral inserts 120.

Figure 4:
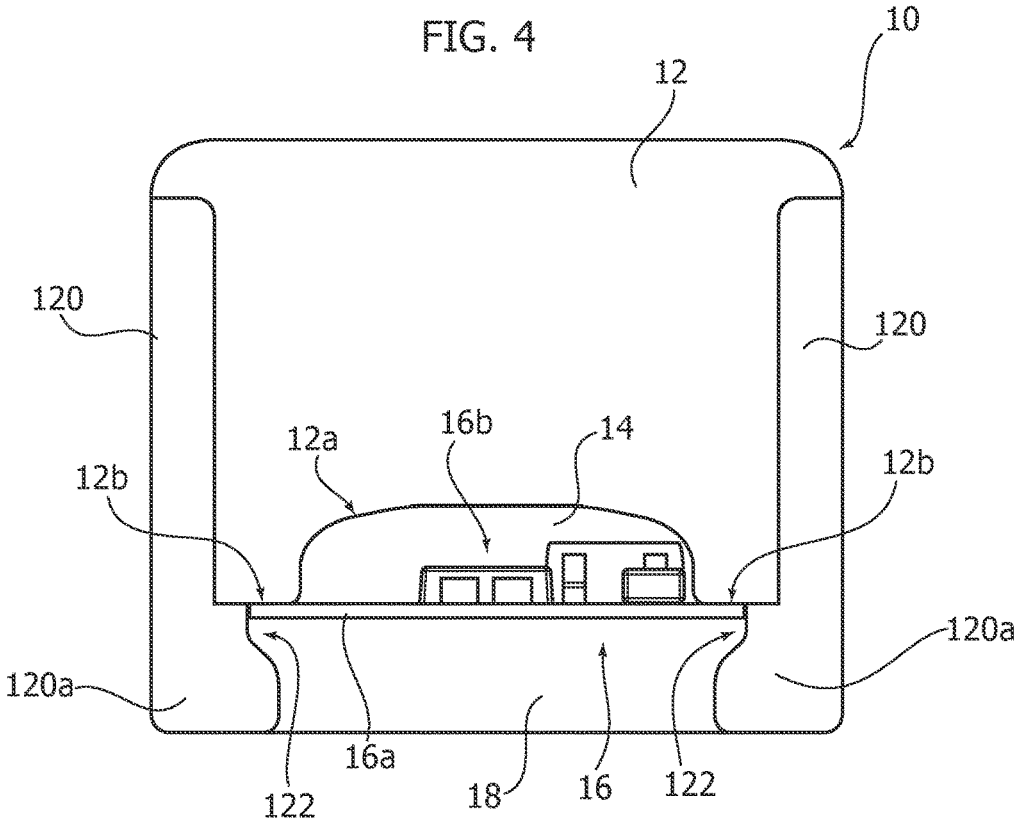

FIG. 4 exemplifies the possibility of providing device 10 with at least one of two sealing or potting masses, i.e.:

a first mass 14, optionally of light-permeable material, sandwiched between light engine 16 and web portion 12 of the profiled body, e.g. at mouth portion 12*a*, which is adapted to house light radiation sources 16*b* and the circuits associated thereto, and a second mass 18, extending on the face of board 16*a* facing outwardly of device 10 (i.e. the face opposed to web portion 12 of the profiled body) from one to the other side portion 120 of the profiled body, so as to impart a protection to device 10 (e.g. IPx grade).

In addition or in alternative to the presently shown solution, wherein light radiation source(s) 16*b* are arranged on the face of board 16*a* facing web portion 12 of profiled body 12, 120, in one or more embodiments light engine 16 may comprise one or more light radiation sources 16*b* arranged on the face of board 16*a* opposed to web portion 12 of profiled body 12, 120. In this case the sealing mass 18, if present, may be comprised of a light-permeable, e.g. transparent, material.

FIG. 1 exemplifies the possibility (which may be provided in the other embodiments as well) for head portions 120*a* of inserts 120, i.e. generally for side walls of profiled body 12, 120, to be spread apart outwards, as schematically shown by the arrows in FIG. 1.

Figure 5:
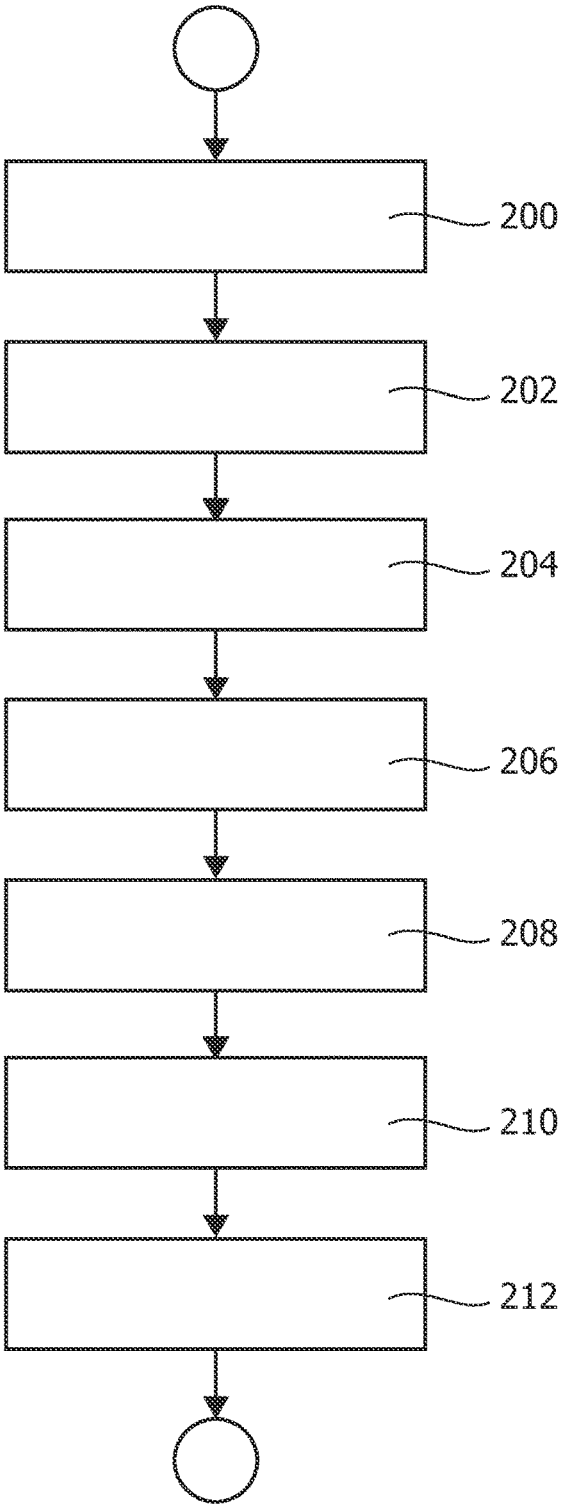
FIG. 5 is a flow chart exemplifying the steps of a method adapted to manufacture a lighting device according to one or more embodiments.

Such a feature may be used, in one or more embodiments, in order to perform the manufacturing method which is schematically shown by the flow chart of FIG. 5.

In this flow chart, step 200 indicates that a profiled body 12, 120 is made available e.g. on a carousel structure.

Step 202 shows the possibility of dispensing, into mouth portion 12*a* of web portion 12 of profiled body or case 12, 120, a sealing material, e.g. a polymer, which may optionally be light-permeable, e.g. transparent, and which forms the sealing mass denoted with 14 in FIG. 4.

In a step 204 (or even previously), side portions 120 of profiled body 12, 120 (e.g. the expanded head portions 120*a*) may be spread apart (as schematically shown in FIG. 1). This may be accomplished e.g. through an opening tool which is fixed, and with respect to which profiled body 12, 120 moves thanks to its mounting on a carousel structure.

At this point, light engine 16 may be "laminated" onto profiled body (which may take place at the same advancing speed), so that the lateral sides of board 16*a* engage undercuts/grooves 122.

In this step, denoted as block 206 in the chart of FIG. 5, side portions (e.g. 120*a*) of the profiled body may be kept spread apart.

In a step denoted as 208, the same side portions may be disengaged from the spreading action, so that they return (with a mutually approaching movement, due e.g. to the fact that they comprise an elastic material) to the position shown with a solid line in FIGS. 1 to 4. In such conditions, light engine 16 is stably retained within profiled body 12, 120.

In a step 210, the additional sealing mass 18 may be dispensed between one and the other side portions 120 of channel-shaped profiled body.

In a further step denoted as 212, the sealing masses 14 and 18 may be cured.

In this step, in the case of a heat curing, the assembly may be prevented from possibly waving and warping because of the heat, thanks to the fact that, although it is retained with respect to profiled body 12, 120, light engine 16 may still slide with respect to body 12, 120 thanks to the engagement of the longitudinal sides of board 16*a* in undercuts 122.

The final result of the process exemplified in FIG. 5 may therefore correspond to the solution shown in FIG. 4.

One or more embodiments may of course allow for different implementations, e.g. as regards the orientation of the light engine, which may face downwards (and not upwards, as in the annexed Figures), as regards the polymers used, the dispensing steps of sealing masses, the possibility of using a process other than a reel-to-reel process, as exemplified herein.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A lighting device, comprising:

a channel-shaped elongate profiled body having a central portion and two side portions sidewise of said central portion, said profiled body with mutually opposed undercuts opening inwardly of the channel shape of the profiled body said undercuts extending lengthwise of the profiled body, and a light radiation source assembly including an elongate support board with at least one electrically-powered light radiation source thereon, said support board having longitudinal sides extending into said undercuts, wherein the light radiation source assembly is retained by said channel-shaped profiled body; and a second sealing mass, with said second mass extending over a face of said support board opposed to said central portion from the one to the other of said side portions of the profiled body.

2. The lighting device of claim 1, wherein said central portion includes a light-permeable material adapted to be traversed by light radiation from said at least one light radiation source, with said at least one light radiation source located at a face of said board facing said central portion.

3. The lighting device of claim 1, wherein said profiled body includes two lateral inserts extending lengthwise of said profiled body to form said two side portions and wherein said undercuts are located between said central portion and said lateral inserts.

4. The lighting device of claim 3, wherein said lateral inserts include a light-impermeable material.

5. The lighting device of claim 1, wherein said central portion has a concave surface facing said light radiation source assembly.

6. The lighting device of claim 1, wherein said profiled body and said support board are flexible.

7. The lighting device of claim 1, further comprising a first sealing mass, said first mass located between said central portion of the profiled body and said light radiation source assembly.

8. The lighting device of claim 1, wherein said at least one light radiation source is an LED source.

9. A method of manufacturing a lighting device, the lighting device comprising:

a channel-shaped elongate profiled body having a central portion and two side portions sidewise of said central portion, said profiled body with mutually opposed undercuts opening inwardly of the channel shape of the profiled body said undercuts extending lengthwise of the profiled body, and a light radiation source assembly including an elongate support board with at least one electrically-powered light radiation source thereon, said support board having longitudinal sides extending into said undercuts, wherein the light radiation source assembly is retained by said channel-shaped profiled body the method comprising:

providing said channel-shaped elongate body with said side portions adapted to be spread apart, spreading apart said side portions, arranging said light radiation source assembly with the longitudinal sides of said support board in said undercuts while said side portions are kept spread apart, and said side portions moving towards each other to capture said support board in said undercuts; and dispensing a second sealing mass with said second mass dispensed on a face of said support board opposed said central portion of the profiled body from the one to the other of said side portions of the profiled body.

10. The method of claim 9, further comprising dispensing at a first sealing mass with said first mass dispensed on said central portion between said side portions.

11. The method of claim 9, further comprising heat curing said second sealing mass.

12. The method of claim 10, further comprising heat curing said first sealing mass.

* * * * *